US006261088B1

(12) United States Patent
Butler

(10) Patent No.: US 6,261,088 B1
(45) Date of Patent: Jul. 17, 2001

(54) FLAME COVER

(75) Inventor: William Robertson Butler, Albuquerque, NM (US)

(73) Assignee: Chace Candles, Inc., Albuquerque, NM (US)

( * ) Notice: Subject to any disclaimer, the term of this patent is extended or adjusted under 35 U.S.C. 154(b) by 0 days.

(21) Appl. No.: 09/665,869

(22) Filed: Sep. 19, 2000

Related U.S. Application Data

(63) Continuation-in-part of application No. 09/243,247, filed on Feb. 3, 1999, now abandoned.

(51) Int. Cl.[7] ..... F23D 3/16; F21V 35/00

(52) U.S. Cl. ..... 431/290; 431/289; 431/291; 431/126; 362/161; 362/180; 362/181

(58) Field of Search ..... 431/290, 291, 431/126, 289; 362/447, 161, 162, 163, 180, 181, 182

(56) References Cited

U.S. PATENT DOCUMENTS

| | | | | |
|---|---|---|---|---|
| Re. 7,091 | * | 5/1876 | Cowles . | |
| 140,448 | * | 7/1873 | Walton . | |
| 183,398 | * | 10/1876 | Howard . | |
| 214,664 | * | 4/1879 | Johnston . | |
| 333,365 | | 12/1885 | Waldron . | |
| 370,770 | * | 10/1887 | Drumheller . | |
| 427,028 | * | 4/1890 | Johnson . | |
| 526,877 | * | 10/1894 | Tolman . | |
| 543,438 | | 7/1895 | Cooper . | |
| 603,427 | | 5/1898 | Gennert . | |
| 814,183 | * | 3/1906 | Aschenbach . | |
| 902,567 | | 11/1908 | Noe . | |
| 1,632,577 | * | 6/1927 | Anderson . | |
| 1,890,378 | | 12/1932 | Godoy . | |
| 2,017,533 | | 10/1935 | Friedrichs | 67/23 |
| 2,254,664 | * | 9/1941 | Quinlin . | |
| 2,469,163 | | 5/1949 | Gilmore | 67/27 |
| 5,193,994 | | 3/1993 | Schirneker | 431/293 |

FOREIGN PATENT DOCUMENTS

| | | | | |
|---|---|---|---|---|
| 2238608 | * | 6/1991 | (GB) | 431/290 |

* cited by examiner

*Primary Examiner*—Carl D. Price
(74) *Attorney, Agent, or Firm*—Peacock, Myers & Adams

(57) ABSTRACT

A flame cover device for use with mechanical candle holders, especially for use with candle holders in which the candle is spring-driven to the top of a tube as the candle is consumed. The apparatus may be removably disposed upon the top portion of the tube of the mechanical candle holder, where it remains motionless while the candle is burned by combustion, yet provides protection from and to the burning flame. A base of the device is engaged with the tube of the mechanical candle holder, with vents in the base providing adequate ventilation to the flame. A transparent shell extends up from the base to provide flame protection. A ring damper is provided for covering the vents in the base to assist the flame in windy conditions.

35 Claims, 5 Drawing Sheets

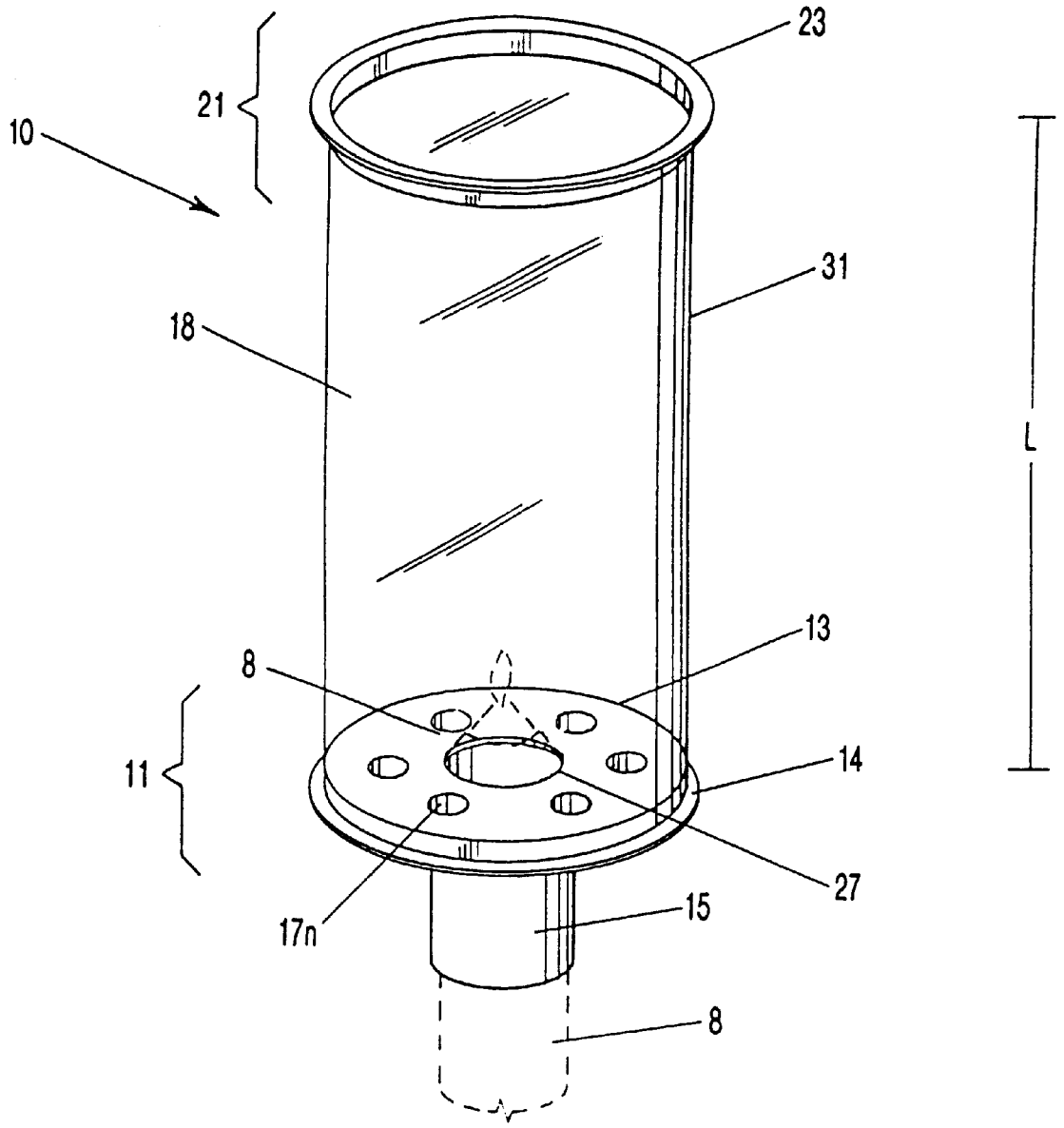
23
21
10
31
18
L
13
8
11
14
27
17n
15
8

FLAME COVER

CROSS-REFERENCE TO RELATED APPLICATIONS

This application is a continuation-in-part of application Ser. No. 09/243,247, entitled "Flame Cover," filed Feb. 3, 1999 now abandoned, the disclosure of which is incorporated by reference.

BACKGROUND OF THE INVENTION

1. Field of the Invention (Technical Field)

The present invention relates to mechanical candle holders, and more particularly, to a removable flame cover for a mechanical candle holder which decreases or prevents the risk of injury or damage from the candle's open flame while simultaneously allowing the mechanical candle to be used in the presence of air currents without extinguishing the flame.

2. Background Art

A mechanical candle holder maintains a candle upon a surface, such as a table. The candle is held by a base, and disposed within a vertically oriented tube, and includes a spring or other mechanical means for urging progressively the candle to the upper portion of the tube, so that the entire candle is ultimately consumed over the course of its burning, but the flame is maintained at a fixed position above the supporting surface. Such a device is disclosed, for example, in U.S. Pat. No, 2,469,163 to Chace Gilmore. Devices manufactured after the teachings of this seminal patent are known in the art as "Chace Candles."

In many areas, governmental fire code regulations prohibit the operation of a lighted candle in an open space without adequate protection. This is true regardless of whether the candle is used in conjunction with a mechanical candle holder. Cities in the United States which typically enforce strict fire codes for candles include Boston, Los Angeles, Philadelphia, New York and Chicago. Thus, businesses (such as restaurants) or organizations (such as religious groups) which desire to have a lighted candle placed on a table are prevented from doing so.

Accordingly, it is an object of the present invention to provide a flame cover for a mechanical candle holder for use in areas which have strict fire codes relating to open or exposed flame candles.

It is a further object of the present invention to provide a flame cover for a mechanical candle holder which is easy to manufacture, simple in construction, economical in cost and which allows for easy insertion onto and removal from a mechanical candle holder.

It is a further object of the present invention to provide a flame cover for a mechanical candle holder which reduces or prevents fire hazards to property or to a person when the mechanical candle is lighted.

Another object of the present invention is to provide a flame cover for a mechanical candle holder which prevents candle flame extinguishment due to adjacent strong air currents while simultaneously allowing the visual enjoyment a lighted candle provides.

Another object of the present invention is to prevent wax drippage.

Yet another object of the present invention is to prevent excessive flame flicker.

SUMMARY OF THE INVENTION

This invention relates to a flame cover device for use with mechanical candle holders, especially for use with candle holders in which the candle is spring-driven to the top of a tube as the candle is consumed. The apparatus may be removably dispose upon the top portion of the tube of the mechanical candle holder, where it remains motionless while the candle is burned by combustion, yet provides protection from and to the burning flame. A base of the device is engaged with the tube of the mechanical candle holder, with vents in the base providing adequate ventilation to the flame. A transparent shell extends up from the base to provide flame protection. A ring damper is optionally provided for covering the vents in the base to extinguish the flame.

The present invention is a removable flame cover apparatus for use with a mechanical candle holder. In a typical candle holder (e.g. Chace Candle), the candle holder comprises a rigid tube main shaft, an upper tapered end and an upwardly-biased candle therein. For use with such a candle holder, the flame cover apparatus of the present invention comprises a base and conduit. The base comprises a rim comprising a plurality of vents and a center opening. The conduit is cylindrical-shaped, depends downwardly from the rim and comprises a center opening. The base further comprises a lip, integral with the rim, extending slightly beyond the rim into the center opening of the conduit. The rim and vents are preferably perpendicular to the conduit. All of the openings are preferably cylindrical.

The conduit is disposable on the rigid tube main shaft of the candle holder and the lip is disposable on the upper tapered end of the candle holder. This allows the flame cover to be seated near the top of the candle holder while preventing the flame cover from sliding down the candle holder. This is accomplished by the diameter of the conduit being slightly larger than the diameter of the main shaft of the candle holder, while the diameter of the lip is just slightly larger than the upward taper of the candle holder and just slightly smaller than the main shaft of the candle holder. The flame cover remains unmoving atop the candle holder while the candle is burned. No other attachments, e.g. clamps or springs, are required.

The flame cover further comprises a hollow shell defining a flame area therein. The shell comprises an upper end and a lower end, the lower end coupled to the rim of the base. The shell is preferably translucent or transparent, and cylindrical in shape. The upper end of the shell may comprise an annulus, preferably with a diameter slightly larger than the shell, so as to prevent breakage if the shell is dropped. The shell is coupled to the rim, preferably by a heat-resistant adhesive. An edge, preferably upwardly extending and perpendicular to the rim, may be provided on the rim to contain and hold the shell in place. The shell is preferably between approximately 3–5 inches in length, and most preferably 4–4.25 inches in length.

In an alternative embodiment, the flame cover apparatus further comprises a damper ring which is used in high wind or breeze conditions so that the flame does not go out, cause undercurrent flame flicker or dripping wax. This damper ring may be inserted, even while the flame is burning, by dropping it into the shell. It then seats itself on the rim and covers the vents.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 1 illustrates a side perspective view of the present invention;

Figure 4:
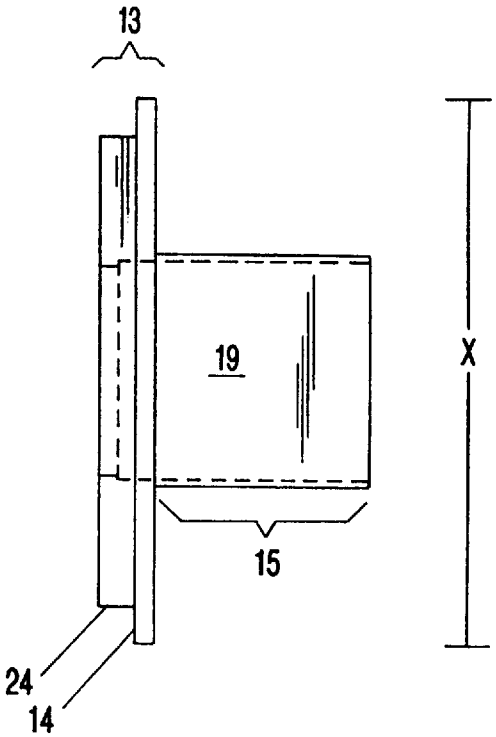
FIG. 4 illustrates a side view of the base of the invention of FIG. 1.

DESCRIPTION OF THE PREFERRED EMBODIMENTS (BEST MODES FOR CARRYING OUT THE INVENTION)

The present invention, a flame cover, is illustrated in FIG. 1. A seen in FIG. 1, the present invention is a flame cover 10 for a mechanical candle holder 8 (such as a Chace Candle holder) comprising three components: a base 11, an annulus 21 (optional) and a shell 31 therebetween.

As illustrated in FIGS. 1–5, base 11 includes a rim 13 coupled to a hollow elongated conduit 15 depending downward from the rim. The upper end of the tube of the mechanical candle holder 8 (such as a Chace Candle holder) is insertable into conduit 15 so that the flame cover 10 can be rested upon the upper end or taper of the tube 8 (as shown in dashed lines) with the tube removably but firmly engaged with the conduit 15 of the base 11. The rim 13 has a lip 27 and center hole defined therein of diameter corresponding generally to the diameter of the channel 19, so that when the flame cover 10 is in use, the upper end of the tube 8 of the mechanical candle holder is disposed through the conduit 15 and extends through the center hole and into the flame area 18. Thus, as the candle burns, the flame cover 10 of the invention remains unmoving atop the tube 8 of the mechanical candle holder, while the candle is consumed and is urged upward within the tube 8.

Rim 13 further includes a plurality of vents $\mathbf{17}_n$ formed therethrough. Preferably, vents $\mathbf{17}_n$ are apertures formed in a circular array around rim 13, each vent $\mathbf{17}_n$ being equidistantly formed from adjacent vents about rim 13. Vents $\mathbf{17}_n$ are useful to provide oxygen to a space that is defined by a partially encapsulated flame area 18 within shell 31 so that the ignited flame has adequate fuel to continue burning. In the preferred embodiment, an edge 14 of rim 13 extends outwardly away from shell 31 to approximately the same diameter as the brim's 23 predefined diameter X (as illustrated in FIG. 4). The shell 31 is engaged with the base by slipping or affixing the shell onto the base with the inside wall of the shell in gentle frictional engagement with the rim wall or edge 24 (see FIG. 2); the outside diameter of the rim wall 24 is just less than the inside diameter of the shell 31. In this regard, the approximate equal diameters of edge 14 and brim 23 protects shell 31 from possible breakage should the candle tip over. However, those skilled in the art will realize that use of annulus 21 is optional, as the present invention may only include base 11 and shell 31 while achieving most of the objects of the present invention. Indeed, omitting the use of an annulus 21 in many instances provides for a more attractive flame cover 10.

Figure 7:
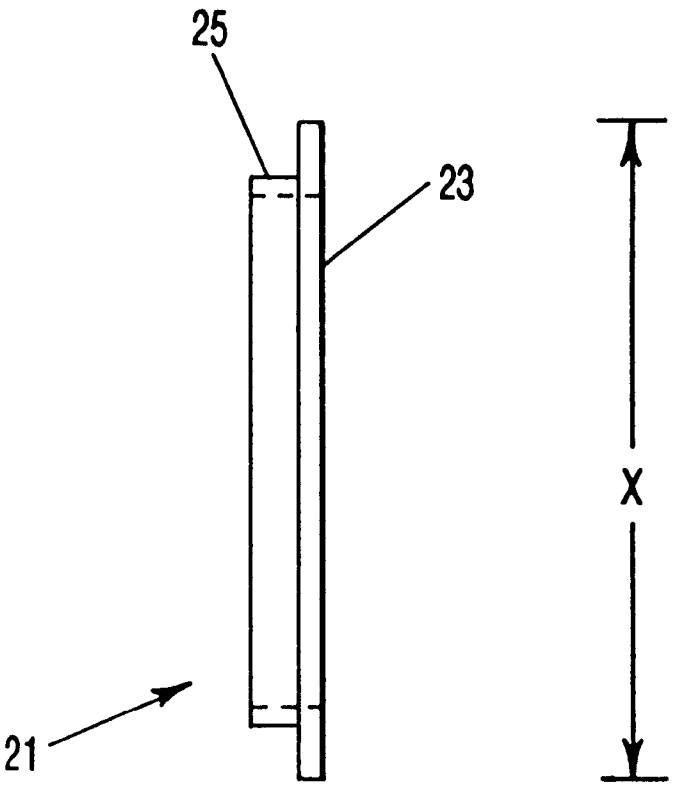
FIG. 7 illustrates a side view of the annulus of the invention of FIG. 1.
Figure 6:
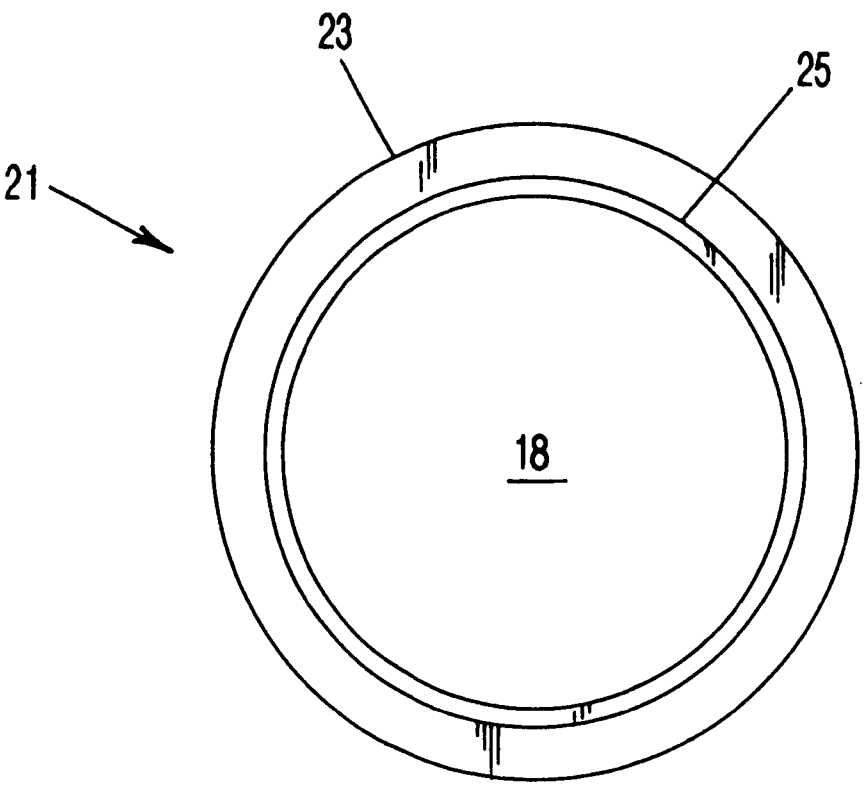
FIG. 6 illustrates a bottom view of the annulus of the invention of FIG. 1.

As seen in FIGS. 6 and 7, optional annulus 21 includes a brim 23 of predefined outside diameter X which encircles and is externally coupled to shell 31. Preferably, annulus 21 is attached to shell 31 via a circular ring 25. It is seen, therefore, that when the flame cover 10 falls or is placed to a horizontal position, for example onto a tabletop, brim 23 and edge 14 of base 11 prevent shell 31 from contacting the horizontal tabletop or other surface, thereby protecting shell 31.

Figure 3:
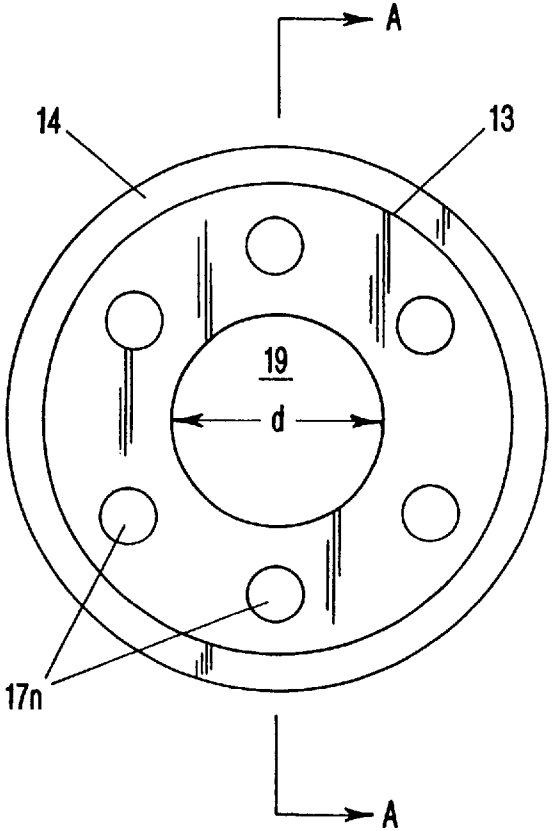
FIG. 3 illustrates a top view of the base of the invention of FIG. 1.
Figure 2:
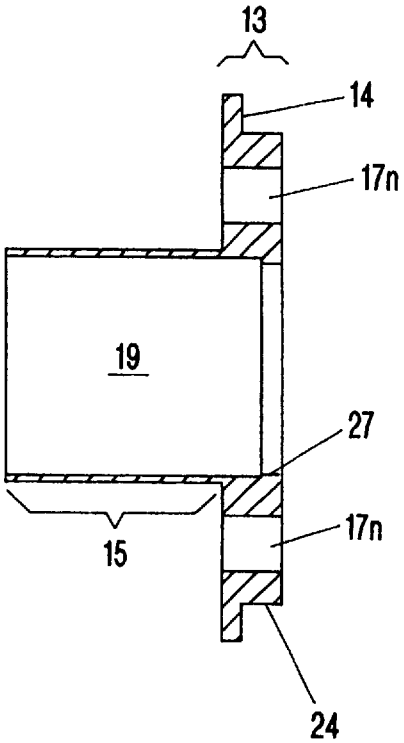
FIG. 2 illustrates a cross sectional side view of the invention of FIG. 1.
Figure 5:
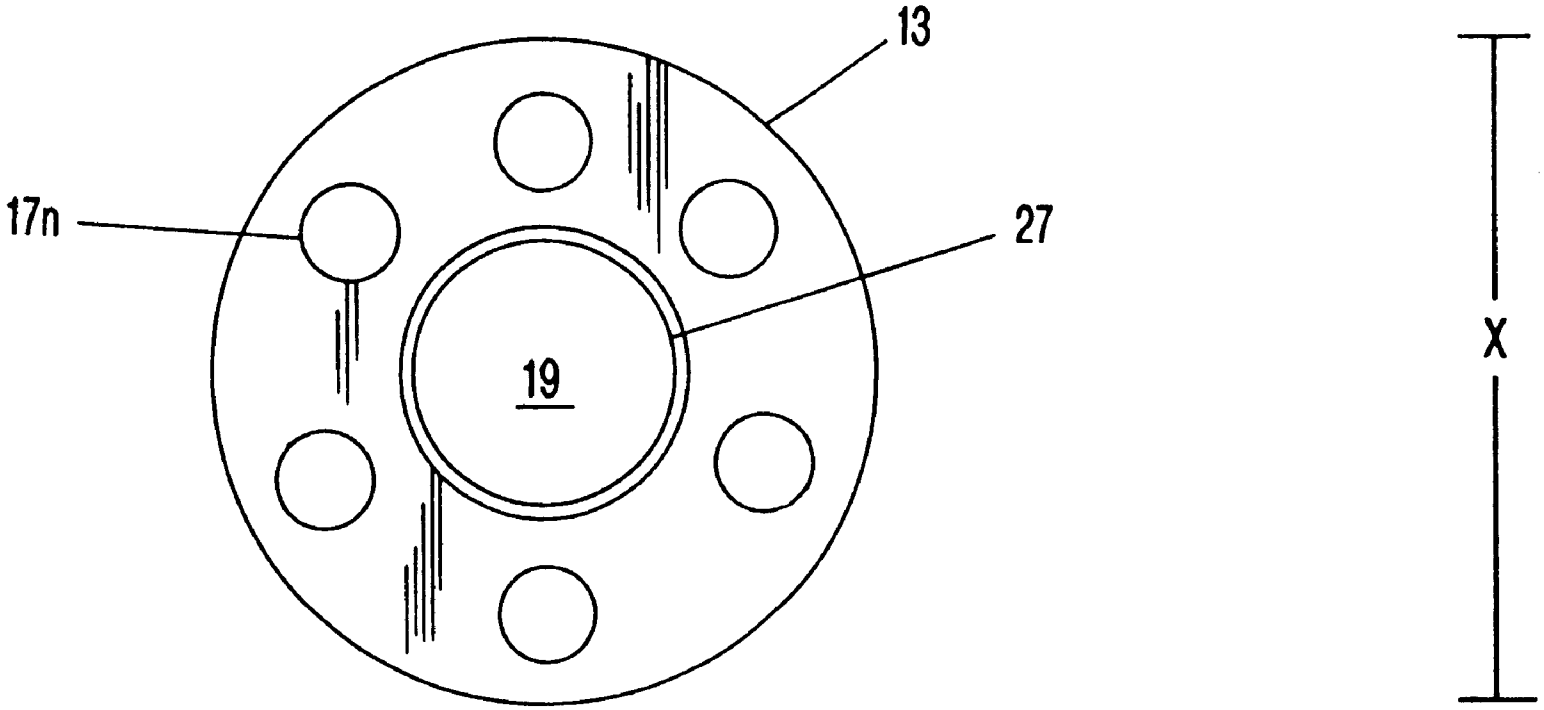
FIG. 5 illustrates a bottom view of the of the invention of FIG. 1.

Additionally, as shown in FIGS. 2, 3 and 5, rim 13 further includes an integral lip or channel 19 of predetermined diameter, sized to receive the upper portion of the candle holder's tube 8 (as illustrated in dashed lines in FIG. 1). The diameter d at the top of conduit 15 and rim 13 is designed to securely receive the top tapered portion of the mechanical candle tube 8.

Both base 11 and annulus 21 are preferably constructed out of a metal, such as aluminum, which can then be finished (e.g. powder coated) to match the color of the candle holder. This allows the user to select a flame cover base 11 and annulus 21 among numerous colors to match the ambiance desired for any particular situation. Aluminum is a lightweight metal which is inexpensive to mold and manufacture. Those of skill in the art will realize, however, that material used to construct base 11 and annulus 21 can be of any metal or alloy, non-inflammable plastic or other suitable material.

As seen in FIGS. 1–7, shell 31 is a hollow, cylindrical structure of a selected length L that, in the preferred embodiment, has a slightly larger diameter than the rim wall 24. As such, the interior wall of shell 31 is designed, on one end, to fit securely over and in tight relationship with rim wall 24. The interior wall of shell 31 is also designed, at another end, to fit securely over ring 25 of annulus 21 in tight relationship. Optionally, when shell 31 is coupled to wall 24 or ring 25, an adhesive (e.g. heat resistant chemical adhesive) is applied which provides a secure coupling between annulus 21 and shell 31, and between base 11 and shell 31. The adhesive should have high heat resistance characteristics to maintain constant attachment between annulus 21 and shell 31, or between base 11 and shell 31.

Shell 31 is preferably constructed from a transparent or translucent heat and breakage resistant material such as Pyrex® glass. In this regard, a lighted candle can be viewed and enjoyed when employing the present invention on a candle holder. Edge 14 and brim 23 extend beyond the diameter of shell 31, thereby offering additional protection against possible breakage.

Finally, the length L of shell 31 is important due to the testing standards developed by fire regulatory agencies. Several fire regulatory agencies have developed flammability testing standards for products such as disclosed by the present invention. One such test, an Ignition Test of Combustibles, which has been conducted by the Los Angeles (California) Fire Department, consists of holding a tissue over the enclosure of the open flame for 10 seconds to determine whether the tissue will ignite. In testing prototypes of the present invention, a length L of approximately more than three inches was used in various tests. A sheet of tissue held over the encapsulated flame area 18 for 10 seconds blackened, but did not ignite, the tissue. Thus, the present invention passed this stringent test employed by the Los Angeles Fire Department. Testing of lengths L of less than approximately three inches resulted in flame ignition of the tissue. As such, the shell's 31 minimum length L should be approximately three inches or more, and it is believed that a length L of approximately between 3–5 inches and most preferably 4–4.25 inches is adequate. In addition to meeting the fire codes, the flame cover protects the flame from breezy currents that cause the flame to move in unattractive and erratic patterns and results in excessive amounts of dripping wax. In most situations of strong wind conditions, the use of the flame cover allows the candle flame to burn in a normal, attractive manner without drippy wax.

In the preferred embodiment, flame cover 10 is designed for receiving Chace Candles or like mechanical candle holders. Further, those skilled in the art will realize that base 11, annulus 21 and shell 31 can be constructed of the same or like materials and continue to be within the spirit and scope of this invention.

Figure 8A:
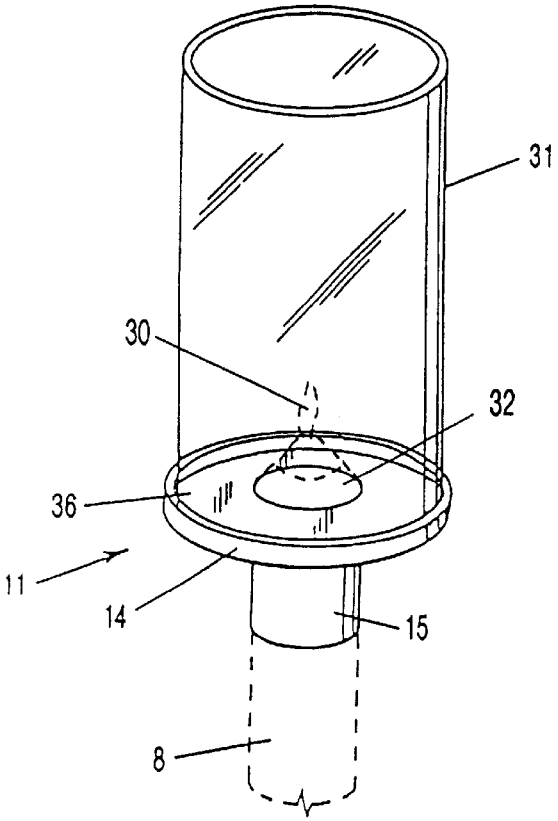
FIG. 8A is a perspective view of an alternative embodiment of the invention, showing a translucent/transparent shell and a damper ring detached from the base of the invention.
Figure 8B:
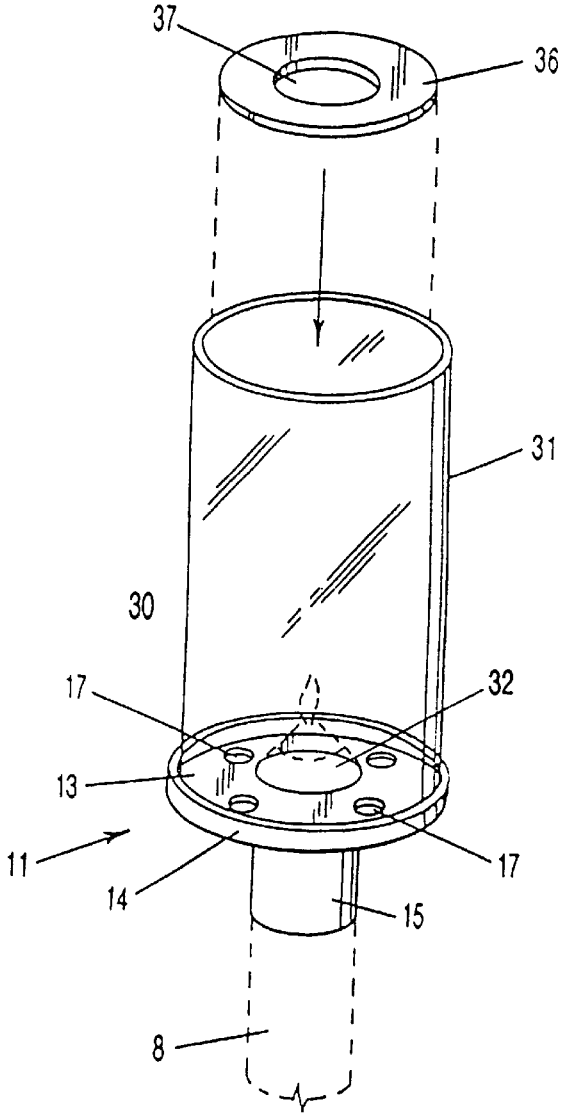
FIG. 8B is another view of the embodiment seen in FIG. 8A, showing the damper ring in place against the base of the invention.

Attention is directed to FIGS. 8A and 8B. In a very desirable alternative embodiment of the flame cover 10, the burning of the flame 30 on the candle 32 may be controlled by providing a ring damper 36 that is disposable within the shell 31. This is useful in windy or high flow air conditions in which vents 17 are unnecessary or provide too much air to the burning candle. The ring damper 36 is a solid planar ring that may be used to cover all the vents 17 in the base, thereby to control the combustion of the flame 30. The ring damper 36 is fashioned from any non-combustible material, and preferably is made of the same material as the base 11 and colored to match it.

As indicated by FIG. 8A, the damper ring 36 has an exterior diameter approximately equal to the inside diameter of the shell 31. The ring damper 36 thus can be placed inside the shell 31, within the flame area 18, and allowed to settle upon the top surface of the rim 13. The damper 36 defines a central aperture 37 therein, which has approximately the same diameter as the tube 8 of the mechanical candle holder. When disposed upon the rim 13 of the base 11, the damper 36 completely covers the vents 17, limiting the air flow to entry from the top of the shell 31, while still allowing the candle to burn. In the illustrated embodiment, the damper 36 is completely solid. In other embodiments, the damper 36 may feature one or more holes therein which are alignable with the vents 17, permitting the damper to be used to reduce the ventilation through the vents, and thus reduce the vigor of the flame.

Accordingly, when it is too windy or breezy, the user drops the damper 36 into the open top end of the shell 31, as suggested by FIG. 8A. The damper 36 falls down in the shell 31 until it settles upon the top of the rim 13, with the tube 8 of the mechanical candle extending through the central aperture 37. The damper 36 thus is centered around the tube of the mechanical candle holder 8, and rests horizontally upon the rim 13 and completely occluding the vents 17, thereby allowing the candle to burn and not be extinguished by the air flow, even in extremely windy conditions.

In use, a candle in a candle holder is first ignited. Then, base 11 is placed on the candle holder 8 as illustrated in FIG. 1. When the candle needs to be changed, or when candle light is no longer required, the flame cover 10 is removed from the candle holder by grasping the conduit 15 and pulling it up and away from the candle holder. Grasping conduit 15 is the safest method of removal, since it is the coolest portion of the present invention when used with a lighted candle. While removal can also be accomplished by grasping any other section of the present invention (such as shell 31), those sections may be warm but likely not warm enough for serious injury. The flame can then be extinguished. In the alternative embodiment of FIGS. 8A and 8B (for windy conditions), the ring damper 36 is dropped into the top of the shell 31. The ring damper of course is removable by the simple expedient of removing the cover 10 from the mechanical holder 8 and inverting the cover to allow the damper 36 to fall by gravity out into one's hand for later re-use.

As those of skill in the art will realize, flame cover 10 provides protection for the candle flame generated by a candle holder from strong air currents generated by wind gusts, forced air units (such as air conditioning or heating units) which may be strong enough to extinguish the flame. Beneficially, the present invention now allows a viewable flame from a candle holder to protect persons (such as diners and food service operators) from possible injury from the candle flames. As such, the present invention can be used in hotels, restaurants, banquet halls, churches or other public areas where city, county or state fire codes prevent open flames.

Another added benefit disclosed allows the use of the present invention with candle holders to substantially reduce glass breakage should the candle tip over and fall. In this regard, shell 31 is formed out of a heat resistant material, and in the preferred embodiment, the heat resistant material is Pyrex® glass. Pyrex® glass is a durable material that allows for viewing the flame when the candle is lighted. When considering the design of the present invention having portion 14 and brim 23, breakage is substantially reduced should the present invention fall or tip over.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A removable flame cover apparatus comprising:

a candle holder base comprising a plurality of air vents and spaced about a central hole;

a hollow shell mounted on said candle holder base and defining a flame area therein; and a solid damper having no openings therein other than a central aperture removably disposable within said shell and upon said base to directly cover and directly close said air vents; and wherein when said damper is disposed upon said base said central aperture corresponds substantially to said central hole.

2. The apparatus of claim 1 wherein said shell further comprises an annulus disposable upon said upper end of said shell.

3. The apparatus of claim 2 wherein said annulus comprises a diameter slightly larger than said shell.

4. The apparatus of claim 1 wherein said shell comprises at least one material selected from the group consisting of transparent and translucent materials.

5. The apparatus of claim 1 wherein said shell comprises a length dimension of between approximately three inches and five inches.

6. The apparatus of claim 5 wherein said shell comprises a length dimension of between approximately four inches and four and one quarter inches.

7. The apparatus of claim 1 wherein said damper comprises a ring shape.

8. The apparatus of claim 1 wherein said damper is removably disposable within said shell when a candle is burning within said shell.

9. The apparatus of claim 1 wherein said shell is cylindrical in shape.

10. The apparatus of claim 1 wherein said shell is coupled to said base by an adhesive.

11. A removable flame cover apparatus for use in combination with a mechanical candle holder, the apparatus comprising:

a mechanical candle holder comprising a rigid tube main shaft and an upper tapered end for disposing an upwardly-biased candle therein;

a base comprising:

a planar rim comprising a plurality of vents and a center opening;

a cylindrical-shaped conduit depending downwardly from said rim and comprising a center opening;

a planar lip of said rim extending slightly beyond said rim into said center opening of said conduit;

said rim and said lip of said rim perpendicular to said conduit;

said conduit disposable on the rigid tube main shaft of said mechanical candle holder and said lip disposable on the upper tapered end of said mechanical candle holder, thereby allowing the flame cover to be seated near the top of said mechanical candle holder while preventing the flame cover from sliding down said mechanical candle holder; and a hollow shell comprising an upper end and a lower end, said lower end coupled to said rim, and said shell defining a flame area therein;

whereby said apparatus remains unmoving atop said mechanical candle holder while the candle is burned.

12. The apparatus of claim 1 wherein said vents are parallel to said conduit.

13. The apparatus of claim 1 wherein said conduit consists essentially of a cylindrical shape defining said opening.

14. The apparatus of claim 1 wherein said rim and lip consist essentially of a cylindrical shape defining said opening.

15. The apparatus of claim 1 wherein said conduit and lip are disposed on and sit upon said mechanical candle holder without any further attachment means.

16. The apparatus of claim 15 wherein said conduit has a diameter just slightly larger than the diameter of the main shaft of said mechanical candle holder.

17. The apparatus of claim 15 wherein said lip has a diameter just slightly larger than the upward taper of said mechanical candle holder and just slightly smaller than the diameter of the main shaft of said mechanical candle holder.

18. The apparatus of claim 1 wherein said shell further comprises an annulus disposable upon said upper end of said shell.

19. The apparatus of claim 18 wherein said annulus comprises a diameter slightly larger than said shell.

20. The apparatus of claim 18 wherein said annulus matches said base in color.

21. The apparatus of claim 20 wherein said annulus and said base match said mechanical candle holder in color.

22. The apparatus of claim 1 wherein said shell comprises at least one material selected from the group consisting of transparent and translucent materials.

23. The apparatus of claim 1 wherein said shell comprises a length dimension of between approximately three inches and five inches.

24. The apparatus of claim 23 wherein said shell comprises a length dimension of between approximately four and four and one quarter inches.

25. The apparatus of claim 1 further comprising a damper removably disposable within said shell and upon said rim to directly cover and directly close said vents.

26. The apparatus of claim 1 wherein said damper comprises a ring shape.

27. The apparatus of claim 1 wherein said damper is removably disposable within said shell when a candle is burning within said shell.

28. The apparatus of claim 1 wherein said base matches the candle holder in color.

29. The apparatus of claim 1 wherein said shell is cylindrical in shape.

30. The apparatus of claim 1 wherein said shell is coupled to said rim by an adhesive.

31. The apparatus of claim 1 wherein said adhesive is heat resistant.

32. The apparatus of claim 1 further comprising an upwardly extending edge from said rim.

33. The apparatus of claim 32 wherein said shell is contained within said edge upon said rim.

34. The apparatus of claim 32 wherein said edge is perpendicular to said rim.

35. The apparatus of claim 1 wherein said lip is integral with said rim.

* * * * *